US007121485B2

(12) United States Patent
Smith

(10) Patent No.: US 7,121,485 B2
(45) Date of Patent: Oct. 17, 2006

(54) MULTI-FUNCTIONAL TOOL ASSEMBLY FOR PROCESSING TOOL OF WASTE PROCESSING MACHINE

(76) Inventor: Leward Nile Smith, Route 4, Box 160, Lake City, FL (US) 32024

( * ) Notice: Subject to any disclaimer, the term of this patent is extended or adjusted under 35 U.S.C. 154(b) by 0 days.

(21) Appl. No.: 11/042,590

(22) Filed: Jan. 25, 2005

(65) Prior Publication Data

US 2005/0121550 A1 Jun. 9, 2005

Related U.S. Application Data

(63) Continuation of application No. 09/970,060, filed on Oct. 3, 2001, now Pat. No. 6,845,931.

(51) Int. Cl.
*B02C 13/288* (2006.01)

(52) U.S. Cl. ..... 241/55; 241/188.1; 241/191

(58) Field of Classification Search ..... 241/55, 241/189.1, 191, 197, 188.1
See application file for complete search history.

(56) References Cited

U.S. PATENT DOCUMENTS

| | | | |
|---|---|---|---|
| 190,675 | A | 5/1877 | Gaines |
| 589,236 | A | 8/1897 | Williams |
| 604,283 | A | 5/1898 | Albrecht |
| 787,290 | A | 4/1905 | Griffin |
| 1,266,894 | A | 5/1918 | Williams |
| 1,559,924 | A | 11/1925 | Willcox |
| 1,713,507 | A | 5/1929 | Ammon |
| 1,752,290 | A | 4/1930 | Ammon |
| 1,761,083 | A | 6/1930 | Liggett |
| 1,860,519 | A | 5/1932 | Wickersham |
| 1,889,129 | A | 11/1932 | Nielsen |
| 1,902,721 | A | 3/1933 | Reynolds |
| 2,026,790 | A | 1/1936 | Mankoff |
| 2,128,194 | A | 8/1938 | Sheldon et al. |
| 2,244,577 | A | 6/1941 | Schreiber |
| 2,318,219 | A | 5/1943 | Harris |
| 2,392,958 | A | 1/1946 | Tice |
| 2,663,505 | A | 12/1953 | Sennholtz |
| 2,705,596 | A | 4/1955 | Poyser |
| 2,710,635 | A | 6/1955 | Alexander |
| 2,863,476 | A | 12/1958 | Clark |
| 2,864,420 | A | 12/1958 | Schmidt |
| 2,900,069 | A | 8/1959 | Manns et al. |
| 3,035,682 | A | 5/1962 | Ferch |
| 3,194,543 | A | 7/1965 | McIlvaine |
| 3,203,532 | A | 8/1965 | Mimnaugh et al. |
| 3,254,687 | A | 6/1966 | Tertyshnikov |
| 3,367,585 | A | 2/1968 | Ratkowski |

(Continued)

FOREIGN PATENT DOCUMENTS

| | | |
|---|---|---|
| JP | 60-140645 | 9/1985 |

(Continued)

OTHER PUBLICATIONS

The Beast Recyclers from Bandit Industries . . . with Big Appetites for Waste, Bandit Industries.

(Continued)

*Primary Examiner*—Mark Rosenbaum
(74) *Attorney, Agent, or Firm*—Bliss McGlynn, P.C.

(57) ABSTRACT

A multi-functional tool for a waste processing machine includes a shaft and a head operatively supported by the shaft. The multi-functional tool also includes a waste reducer operatively supported by the head to reduce waste material and a fan operatively supported by the head and disposed radially below the waste reducer to aggressively output the reduced waste material from the waste processing machine.

15 Claims, 3 Drawing Sheets

U.S. PATENT DOCUMENTS

| | | | |
|---|---|---|---|
| 3,436,028 | A | 4/1969 | Koehnen et al. |
| 3,509,924 | A | 5/1970 | Newhouse, Jr. |
| 3,642,214 | A | 2/1972 | Blackwell, Jr. |
| 3,844,494 | A | 10/1974 | Hightower |
| 3,907,016 | A | 9/1975 | Nicholson et al. |
| 4,000,859 | A | 1/1977 | Whitney |
| 4,060,961 | A | 12/1977 | Anderson et al. |
| 4,074,594 | A | 2/1978 | Dall et al. |
| 4,076,177 | A | 2/1978 | Hirayama et al. |
| 4,077,450 | A | 3/1978 | Ackerman |
| 4,077,573 | A | 3/1978 | Kersey et al. |
| 4,117,985 | A | 10/1978 | Lazareck |
| 4,129,260 | A | 12/1978 | Baker |
| 4,129,262 | A | 12/1978 | Lowry |
| 4,146,184 | A | 3/1979 | Whitney |
| 4,146,185 | A | 3/1979 | Schober |
| 4,162,769 | A | 7/1979 | Lapointe |
| 4,162,770 | A | 7/1979 | Lewis |
| 4,168,035 | A | 9/1979 | Palm et al. |
| 4,344,581 | A | 8/1982 | Redemann |
| 4,504,019 | A | 3/1985 | Newell et al. |
| 4,558,826 | A | 12/1985 | Martinek |
| 4,573,643 | A | 3/1986 | Orphall et al. |
| 4,688,731 | A | 8/1987 | Hunt et al. |
| 4,702,424 | A | 10/1987 | Widlak |
| 4,717,083 | A | 1/1988 | Quast et al. |
| 4,848,681 | A | 7/1989 | Eriksson et al. |
| 4,850,406 | A | 7/1989 | Krautzberger |
| 4,872,500 | A | 10/1989 | Duffey et al. |
| 4,915,310 | A | 4/1990 | Stelk |
| 4,917,314 | A | 4/1990 | Manschwetus |
| 4,922,977 | A | 5/1990 | Colton et al. |
| 4,967,969 | A | 11/1990 | Griffith, III |
| 4,982,904 | A | 1/1991 | Greiner |
| 5,002,233 | A | 3/1991 | Williams |
| 5,042,727 | A | 8/1991 | Plante |
| 5,044,567 | A | 9/1991 | Hausler et al. |
| 5,078,328 | A | 1/1992 | Willingham |
| 5,114,085 | A | 5/1992 | Inui |
| 5,205,496 | A | 4/1993 | O'Donnell et al. |
| 5,209,278 | A | 5/1993 | Carpenter et al. |
| 5,285,974 | A | 2/1994 | Cesarini |
| 5,372,316 | A | 12/1994 | Bateman |
| 5,377,919 | A | 1/1995 | Rogers et al. |
| 5,381,971 | A | 1/1995 | Rehmer |
| 5,392,999 | A | 2/1995 | Konig et al. |
| 5,404,993 | A | 4/1995 | Scarro |
| 5,413,286 | A | 5/1995 | Bateman |
| 5,435,689 | A | 7/1995 | Stonehouse |
| 5,474,239 | A | 12/1995 | Williams, Jr. et al. |
| 5,507,441 | A | 4/1996 | De Boef et al. |
| 5,526,988 | A | 6/1996 | Rine |
| 5,529,249 | A | 6/1996 | Braun et al. |
| 5,605,291 | A * | 2/1997 | Doskocil ..... 241/55 |
| 5,611,496 | A | 3/1997 | Fleenor |
| 5,713,525 | A | 2/1998 | Morey |
| 5,743,314 | A | 4/1998 | Puch |
| 5,863,003 | A | 1/1999 | Smith |
| 5,938,129 | A | 8/1999 | Forsyth |
| 6,016,979 | A | 1/2000 | Squires et al. |
| 6,047,912 | A | 4/2000 | Smith |
| 6,059,210 | A | 5/2000 | Smith |
| 6,299,082 | B1 | 10/2001 | Smith |
| 6,517,020 | B1 | 2/2003 | Smith |
| 6,845,931 | B1 * | 1/2005 | Smith ..... 241/55 |

FOREIGN PATENT DOCUMENTS

| | | |
|---|---|---|
| JP | 64-7960 | 1/1989 |
| JP | 1-65650 | 4/1989 |
| JP | 8-299825 | 11/1996 |

OTHER PUBLICATIONS

The Beast—Coming in the Summer of 1993 from Bandit Industries, Inc., Bandit Insutries, Inc.
Maxigrind by Rexworks, The Most Versatile Materials Processing Machine.
Industrial Grinder, Big Bite, Manufactured by Haybuster.
"Product Release" for the new Model 15-H Beast Recycler Offered by Bandit Industries, Waste Handling Equipment New, Jun. 1994.
For Your Chipping and Grinding Needs, Bandit Industries, Inc., Forest Products Equipment, Aug. 1994.
Megagrind by Rexworks 800, 1995.
How to chop yard waste costs!, 1000 Commercial Grinder, Farmhand.
The Beast, Model 15-H, Bandit Industries, Inc.
Bandit Industries' Model 15-H Beast Recycler, Forest Products Equipment, Aug. 1994.
The Model 15 Beast, Bandit Industries, Inc., MSW Management, Mar./Apr. 1994.
Want to Lower the Cost of Breaking Down Yard and Other Landfill Waste? . . . Try the Beast from Bandit, Resource Recycling, Nov. 1994.
Turn Your Green Waste Into Green Dollars, Bandit Industries, Inc., Sportsturf, 1994.
Wood Waste Disposal Problems: Bandit Has Some Answers!, Bandit Industries, Inc. Hard Hat News, Oct. 22, 1993.
Bandit Industries, Inc., Reader Card 218, Forest Publications, Timber West, Nov. 1993.
The Beast, Model 30 Grinding Yard Waste, Model 15, Grinding Housing Demolition, Waste Handling Equipment News, Sep. 1994.
Bandit's Beast Maintains Nature's Beauty, Construction Equipment Guide, Jun. 1, 1994.

* cited by examiner

MULTI-FUNCTIONAL TOOL ASSEMBLY FOR PROCESSING TOOL OF WASTE PROCESSING MACHINE

CROSS-REFERENCE TO RELATED APPLICATION(S)

The present application is a continuation of U.S. patent application Ser. No. 09/970,060, filed Oct. 3, 2001, now U.S. Pat. No. 6,845,931.

BACKGROUND OF THE INVENTION

1. Field of the Invention

The present invention relates generally to waste processing machines and, more particularly, to a multi-functional tool assembly for a processing tool of a waste processing machine.

2. Description of the Related Art

It is known to provide waste processing machines to reduce waste material. The waste processing machine typically includes a rotor assembly for reducing the waste material as the rotor assembly rotates. An example of such a rotor assembly for a waste processing machine is disclosed in U.S. Pat. No. 5,863,003, Issued Jan. 26, 1999, to Smith, entitled "WASTE PROCESSING MACHINE". In that patent, the rotor assembly includes a rotor having a plurality of spaced pairs of mounting arms. The rotor assembly also includes a processing tool mounted to each pair of mounting arms. An example of such a processing tool is disclosed in U.S. Pat. No. 6,047,912, issued Apr. 11, 2000, to Smith, entitled "BREAK-AWAY PROCESSING TOOL FOR A WASTE PROCESSING MACHINE". In that patent, the processing tool includes a tool holder attached to the mounting arms of the rotor assembly by fasteners. The tool holder has a pair of spaced arms extending radially with a tool for reducing waste product attached to one arm and a wear bar or raker for depth limiting guiding attached to the other arm. Typically, the tool is of a single cutting, bullet, or fan type having a head attached to a shaft by suitable means such as brazing. The shaft of the tool is extended through an aperture in the arm of the processing tool and secured thereto by a fastener such as a nut.

Typically, the tool of the cutting type is used for cutting waste material and provides aggressive intake of waste material, but poor output of reduced waste material. The tool of the bullet type is used for splitting waste material to reduce it without cutting and provides aggressive intake of waste material, but provides poor output of reduced waste material. The tool of the fan type is used for impacting waste material such as grass and leaves to reduce it without cutting and provides poor intake of waste material, but provides aggressive output of reduced waste material.

An example of the above tools are disclosed in U.S. Pat. No. 6,059,210, issued May 9, 2000, to Smith, entitled "ROTOR ASSEMBLY FOR A WASTE PROCESSING MACHINE". In that patent, the rotor assembly included a rotor and a plurality of processing tools mounted to the rotor. The processing tools comprise a combination of at least two different types of tools to provide aggressive intake of waste material and aggressive output of reduced waste material in the waste processing machine.

Recently, one application of the waste processing machine is for reducing roofing shingles. Typically, the roofing shingles have an abrasive bonded to a matting. When the roofing shingles are reduced in the rotor assembly, the abrasive circulates past the cutting tool, resulting in abrasion of the processing tool and the rotor assembly. If the abrasion is severe, the entire processing tool or the rotor assembly must be replaced, which is expensive, time consuming, and undesired. Therefore, it is critical to get the abrasive out of the rotor assembly as quickly as possible.

Therefore, it is desirable to provide a multi-functional tool for a waste processing machine that will aggressively reduce waste material and aggressively output reduced waste material. It is also desirable to provide a single multi-functional tool in a waste processing machine for reducing waste material and aggressively outputting the reduced waste material. It is further desirable to provide a multi-functional tool for reducing roofing shingles and aggressively outputting the abrasive from a rotor assembly of a waste processing machine. It is still further desirable to provide a multi-functional tool for a waste processing machine that reduces wear of a tool holder of a processing tool when reducing waste material containing an abrasive. Therefore, there is a need in the art to provide a multi-functional tool assembly for a processing tool of a waste processing machine that allows a single tool to both reduce waste material and to aggressively output the reduced waste material.

SUMMARY OF THE INVENTION

It is, therefore, one object of the present invention to provide a multi-functional tool assembly for a processing tool of a waste processing machine.

It is another object of the present invention to provide a multi-functional tool assembly for a processing tool of a waste processing machine that prevents wear of the processing tool.

To achieve the foregoing objects, the present invention is a multi-functional tool for a waste processing machine. The multi-functional tool includes a shaft and a head operatively supported by the shaft. The multi-functional tool also includes a waste reducer operatively supported by the head to reduce waste material and a fan operatively supported by the head and disposed radially below the waste reducer to aggressively output the reduced waste material from the waste processing machine.

One advantage of the present invention is that a multi-functional tool assembly is provided for a processing tool of a waste processing machine. Another advantage of the present invention is that the multi-functional tool assembly has a single multi-functional tool that allows waste material to be reduced and aggressively outputs the reduced waste material from the rotor assembly in the waste processing machine. Yet another advantage of the present invention is that the multi-functional tool assembly has a multi-functional tool that aggressively outputs the reduced waste material to prevent wear of the tool holder of the processing tool. Still another advantage of the present invention is that the multi-functional tool reduces roofing shingles and aggressively outputs the abrasive of the roofing shingles from the rotor assembly of the waste processing machine.

Other objects, features, and advantages of the present invention will be readily appreciated, as the same becomes better understood, after reading the subsequent description when considered in connection with the accompanying drawings.

DESCRIPTION OF THE PREFERRED EMBODIMENT(S)

Figure 1:
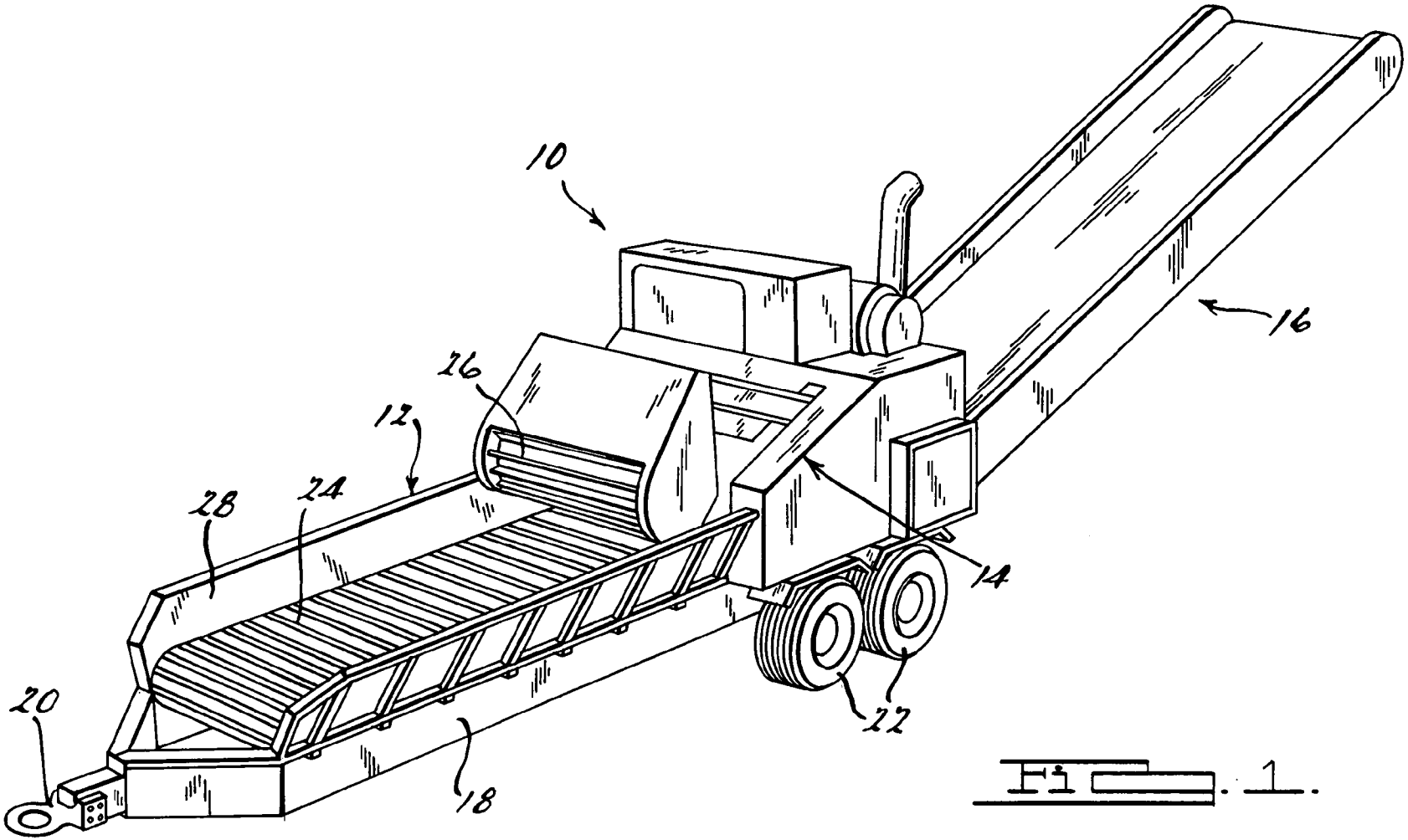
FIG. 1 is a perspective view of a waste processing machine.

Referring now to the drawings and in particular to FIG. 1, one embodiment of a waste processing machine 10 for reducing waste material is shown. The waste processing machine 10 includes an infeed system 12, a waste reducing system 14, and a discharge system 16. Waste material enters the waste processing machine 10 through the infeed system 12 where it is directed to the waste reducing system 14. The waste reducing system 14 reduces the waste material and directs it to the discharge system 16 where the reduced waste material is expelled from the waste processing machine 10. The waste processing machine 10 may be supported on a trailer framework 18 having a tongue mount 20 provided at a front thereof and wheels 22 near a rear of the framework 18. It should be appreciated that, with this structure, the infeed system 12 and waste reducing system 14 can be transported together while the discharge system 16 can be transported separately therefrom.

Figure 2:
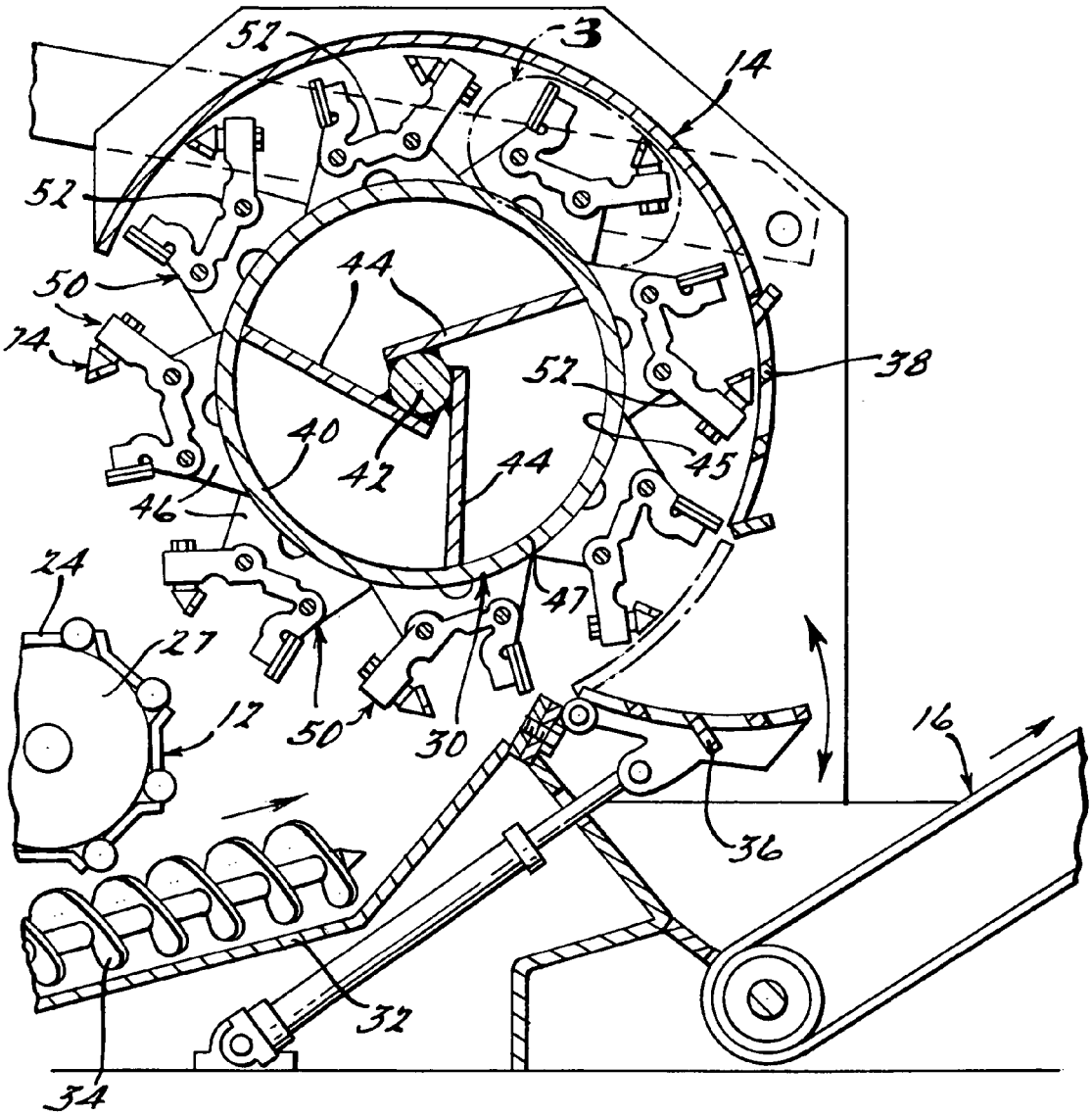
FIG. 2 is a fragmentary elevational view of a rotor assembly of the waste processing machine of FIG. 1.
Figure 5:
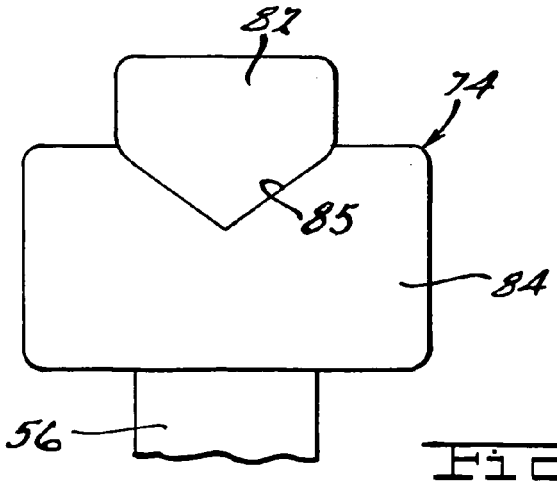
FIG. 5 is a fragmentary elevational view of a multi-functional tool assembly, according to the present invention, of the processing tool of FIG. 4.

Referring to FIGS. 1 and 2, the infeed system 12 includes an infeed conveyor 24 and a feed wheel assembly 26. The infeed conveyor 24 has a terminal end 27 spaced a predetermined distance such as one quarter inches (0.25 inches) from a rotor assembly 30 to be described of the waste reducing system 14. The infeed conveyor 24 is the sole means of support for the waste material and acts as a primary anvil for reducing the waste material by the rotor assembly 30 to be described. Opposed side walls 28 are provided on opposite sides of the infeed conveyor 24 to contain the waste material. It should be appreciated that waste material is placed on the infeed conveyor 24, which moves the waste material into contact with the feed wheel assembly 26, which, in turn, rotates and feeds the waste material into contact with the rotor assembly 30 of the waste reducing system 14.

Figure 3:
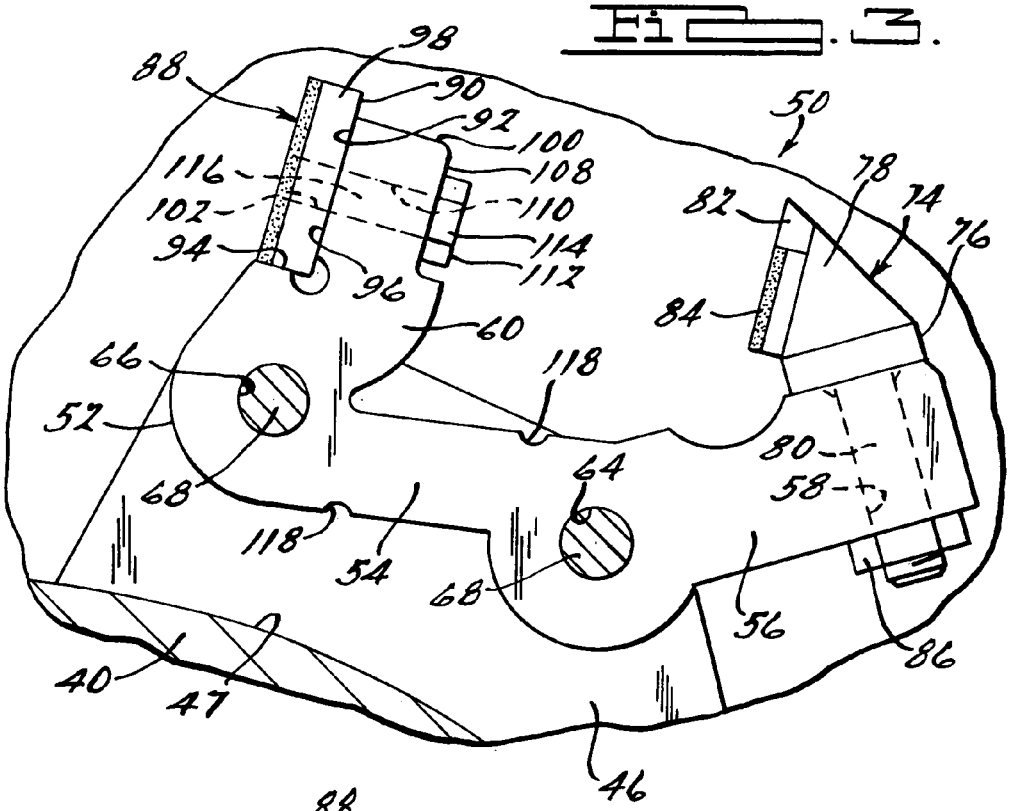
FIG. 3 is an enlarged fragmentary elevational view of a processing tool, according to the present invention, of the rotor assembly in circle 3 of FIG. 2.

Referring to FIGS. 2 and 3, the waste reducing system 14 includes a rotor assembly, according to the present invention and generally indicated at 30. The waste reducing system 14 also includes a housing 32 disposed about the rotor assembly 30 and a plurality of regrind augers 34 positioned at a bottom of the housing 32. The waste reducing system 14 further includes a movable concave screen 36 and a fixed concave screen 38 at a rear of the housing 32. It should be appreciated that the waste reducing system 14 reduces waste material by the rotor assembly 30, which passes through the screens 36,38 to the discharge system 16. It should also be appreciated that the regrind augers 34 move reduced waste product into contact with the rotor assembly 30 for further reduction to pass through the screens 36,38.

The rotor assembly 30 also includes a rotatable rotor 40 disposed within the housing 32 above the regrind augers 34. The rotor 40 is a generally cylindrical tube having a longitudinal axis. The rotor 40 is mounted to a coaxially disposed shaft 42 by multiple braces 44 extending tangentially from an outer surface of the shaft 42 to an inner surface 45 of the rotor 40. Preferably, each brace 44 is an elongated plate-like member fixed tangentially to the shaft 42 by suitable means such as welding and is similarly secured to the inner surface 45 of the rotor 40 by suitable means such as welding. It should be appreciated that a power source (not shown) is connected to the shaft 42 in a well-known manner and is adapted to turn the shaft 42 and rotor 40.

Figure 4:
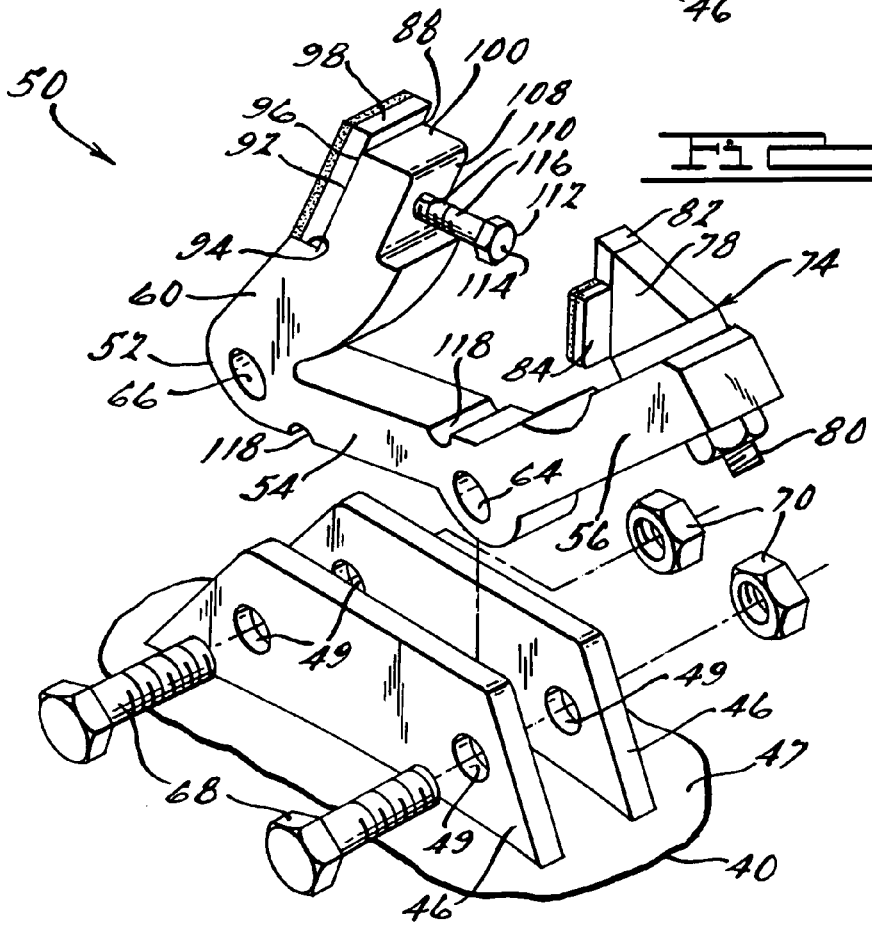
FIG. 4 is an exploded perspective view of the processing tool of FIG. 3.

Referring to FIGS. 2 through 4, the rotor assembly 30 also includes a plurality of spaced pairs of mounting arms 46 mounted to an outer surface 47 of the rotor 40 by suitable means such as welding. Each mounting arm 46 is generally trapezoidal in shape and includes at least one, preferably a pair of spaced apertures 49 extending therethrough. The mounting arms 46 are wrapped about the rotor 40 in a first spiral and a second spiral spaced or offset from the first spiral. The rotor assembly 30 further includes a plurality of processing tools, according to the present invention and generally indicated at 50, mounted to the mounting arms 46. The first spiral and second spiral of mounting arms 46 extend about the rotor 40 so that in one rotation of the rotor assembly 30, every point on an imaginary axial line segment positioned adjacent to the rotor assembly 30 will be contacted by the processing tools 50 mounted to the rotor assembly 30.

Each of the processing tools 50, according to the present invention, includes a tool holder 52 having a general "C" shape. The tool holder 52 has a body 54 extending circumferentially and a first or trailing arm 56 extending radially at an angle therefrom with a first aperture 58 extending therethrough. The tool holder 52 also includes a second or leading arm 60 extending radially at an angle from the body 54. The tool holder 52 includes an aperture 64 and 66 at a lower radial end of the first arm 56 and second arm 60, respectively, and extending axially therethrough. The body 54 has a width or thickness less than the first arm 56 and the second arm 60. The tool holder 52 is continuous, integral, unitary, and made as one-piece. It should be appreciated that the apertures 64,66 of the tool holder 52 are aligned with the apertures 49 of the mounting arms 46.

The rotor assembly 30 includes at least one, preferably a pair of fasteners such as bolts 68 and nuts 70 for retaining the processing tools 50 to the mounting arms 46. The bolts 68 extend through the apertures 49 in the mounting arms 46 and the apertures 64,66 of the tool holder 52 and threadably engage the nuts 70. It should be appreciated that the tool holder 52 is disposed between the mounting arms 46.

The processing tool 50 also includes a multi-functional tool assembly, generally indicated at 74 and according to the present invention, attached to the tool holder 52. The multi-functional tool assembly 74 includes a multi-functional tool 76 to reduce the waste material and to aggressively output the reduced waste material by pushing the reduced waste material to the screens 36,38 and out of the rotor assembly 30. The multi-functional tool 76 has a head 78 and a shaft 80 attached to the head 78 by suitable means such as brazing. The multi-functional tool 76 has a waste reducer 82 such as a cutter attached to the head 78 and a fan 84 disposed adjacent the waste reducer 82 and attached to the head 78. The waste reducer 82 is made of a carbide material and is attached to the head 78 by suitable means such as brazing. The waste reducer 82 is generally rectangular or pentagonal in shape and is used to cut or reduce the waste material. It should be appreciated, that in another embodiment, the waste reducer 82 may be a splitter (not shown) attached to the head 78 such as in U.S. Pat. No. 6,059,210, previously described.

The fan 84 is generally rectangular in shape. The fan 84 has a width greater than the height thereof. The fan 84 may have a recess 85 to receive a portion of the waste reducer 82. Preferably, the fan 84 is disposed radially one half inch back or inward from an outer periphery of the waste reducer 82 to provide one inch of clearance between the fan 84 and an inner surface of the housing 32 of the rotor assembly 30. The fan 84 is made of a metal material such as a one-piece hard faced material such as Trimay and is attached to the head 78 by suitable means such as brazing. The shaft 80 extends axially through the aperture 58 in the first arm 56 and is removably secured to the first arm 56 by suitable means such as a nut 86 threadably engaging the shaft 80. It should be appreciated that the fan 84 is not a cutting tooth and does not reduce the waste material, but aggressively outputs the reduced waste material. It should also be appreciated that the waste reducers 82 are typically one inch apart axially and the fan 84 is typically two inches wide axially to cover a space between the waste reducers 82. It should further be appreciated that the fan 84 may have any suitable shape or area to push reduced waste material for aggressive output thereof.

Referring to FIGS. 2 through 5, the processing tool 50 also has a replaceable raker assembly, generally indicated at 88, removably attached to the second arm 60. The replaceable raker assembly 88 includes a raker 90 disposed in a recess 92 on a forward side of a free end of the second arm 60. The recess 92 is generally rectangular in shape and has a lower surface 94 and a side surface 96. The raker 90 includes a raker wear bar 98 disposed in the recess 92. The raker wear bar 98 is generally rectangular in shape. The raker wear bar 98 is of such a length to extend outwardly beyond a radial end surface 100 of the second arm 60 when disposed in the recess 92. The raker wear bar 98 rests against and is supported by the lower surface 94 and side surface 96. The raker wear bar 98 has an aperture 102 extending axially therein for a function to be described. The raker wear bar 98 is made of a metal material such as a one-piece hard faced material such as Trimay.

The replaceable raker assembly 88 also includes another recess 108 on a rear side of a free end of the second arm 60 opposite the recess 92. The recess 108 is generally rectangular in shape. The replaceable raker assembly 88 includes an aperture 110 extending from the recess 108 to the recess 92 in the second arm 60. The replaceable raker assembly 88 further includes a fastener such as a bolt 112 to removably secure the raker wear bar 98 to the second arm 60. The bolt 120 has a head 114 disposed in the recess 108 and a threaded shaft 116 extending axially from the head 114 and through the aperture 110 in the second arm 60 and threadably engaging the threads of the aperture 102 in the raker wear bar 98. The bolt 112 is of a sufficient length to extend through the second arm 60 and into the raker wear bar 98 in an unobstructed manner without penetrating the front face of the raker wear bar 98. It should be appreciated that the second arm 60 operates as a depth-limiting guide.

The processing tool 50 may include at least one notch 118 in the tool holder 52 to control breakage of the processing tool 50. Preferably, the processing tool 50 includes a first notch 118 in the body 54 adjacent to the first arm 56 between the first arm 56 and second arm 60 on a radial outer side thereof and a second notch 118 in the body 54 adjacent to the second arm 60 between the first arm 56 and second arm 60 on a radial inner side thereof. The notches 118 extend axially across the body 54 of the tool holder 52. The notches 118 are generally arcuate in shape and have a depth of approximately one-quarter inches (0.25 inches). The position, shape, and depth of the notches 118 are varied to control breakage of the tool holder 52 relative to either the first arm 56 or second arm 60 of the tool holder 52.

In operation, the processing tool 50 is rotated by the rotor 40. The multi-functional tool 76 contacts waste product, such as a roofing shingle, first approximately three revolutions before the raker wear bar 98 contacts the waste product. The waste reducer 82 cuts or splits the waste product to reduce the waste product and the fan 84 pushes the reduced waste material toward the screens 36,38 of the rotor assembly 30. If the waste product is stuck or lodged by the multi-functional tool 76 in the waste processing machine 10, the first arm 56 will concentrate stress on the tool holder 52 in the notch 118 adjacent to the first arm 56 and cause a breakage by propagating a crack from the notch 118 radially across the body 54 of the tool holder 52. As such, the first arm 56 will then pivot about the bolt 68 which acts as a first pivot pin and remain attached to the mounting arms 46 to prevent damage to the rotor assembly 30. In addition, the remainder of the tool holder 52 including the body 54 and second arm 60 will pivot about the other bolt 68 which acts as a second pivot pin and remain attached to the mounting arms 46 to prevent damage to the rotor assembly 30. The tool holder 52 can then be replaced. It should be appreciated that the multi-functional tool 76 reduces the waste product and aggressively outputs the reduced waste product from the rotor assembly 30.

During operation, if the raker wear bar 98 becomes worn due to contact with the waste product, the bolt 112 may be removed by unthreading the threaded shaft 116 from the raker wear bar 98. The worn raker wear bar 98 can be discarded and replaced with a new raker wear bar 98. The bolt 112 is then threaded with the threads of the aperture 102 to secure the raker wear bar 98 in place.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A single multi-functional tool for a waste processing machine comprising:

a shaft;

a head operatively supported by said shaft;

a waste reducer operatively supported by said head to reduce waste material; and a fan operatively supported by said head and disposed radially below and adjacent to said waste reducer to aggressively output the reduced waste material from the waste processing machine.

2. A single multi-functional tool as set forth in claim 1 wherein said fan has an axial width greater than said waste reducer.

3. A single multi-functional tool as set forth in claim 1 wherein said waste reducer is a cutter made of a carbide material for cutting waste material.

4. A single multi-functional tool as set forth in claim 1 wherein said fan is made of a metal material.

5. A single multi-functional tool as set in claim 1 wherein said fan has a generally rectangular shape.

6. A single multi-functional tool as set forth in claim 1 wherein said waste reducer is generally rectangular in shape.

7. A processing tool for a waste processing machine comprising:

a tool holder for attachment to a rotor assembly of the waste processing machine; and a single multi-functional tool attached to said tool holder to reduce waste material comprising a shaft, a head operatively supported by said shaft, a waste reducer operatively supported by said head to reduce waste material, and a fan operatively supported by said head and disposed radially below and adjacent to said waste reducer to aggressively output the reduced waste material from the rotor assembly of the waste processing machine.

8. A processing tool as set forth in claim 7 wherein said tool holder comprises a first arm extending radially and a second arm extending radially and spaced from said first arm.

9. A processing tool as set forth in claim 8 wherein said multi-functional tool is attached to said first arm.

10. A processing tool as set in claim 7 wherein said fan has a width greater than said waste reducer.

11. A processing tool as set forth in claim 7 wherein said waste reducer is a cutter made of a carbide material for cutting waste material.

12. A processing tool as set forth in claim 7 wherein said fan is made of a metal material.

13. A processing tool as set in claim 7 wherein said fan has a generally rectangular shape.

14. A processing tool for a waste processing machine comprising:

a tool holder for attachment to a rotor assembly of the waste processing machine, said tool holder comprising a first arm extending radially and a second arm extending radially and spaced from said first arm;

a single multi-functional tool attached to said first arm to reduce waste material comprising a shaft, a head operatively supported by said shaft, a waste reducer operatively supported by said head to reduce waste material, and a fan operatively supported by said head and disposed radially below and adjacent to said waste reducer to aggressively output the reduced waste material from the rotor assembly of the waste processing machine; and a raker attached to said second arm.

15. A processing tool for a waste processing machine comprising:

a tool holder for attachment to a rotor assembly of the waste processing machine, wherein said tool holder includes a first arm extending radially and a second arm extending radially and spaced from said first arm; and a single multi-functional tool comprising a shaft attached to either one of said first arm and said second arm of said tool holder, a head operatively supported by said shaft, a cutter operatively supported by said head to reduce waste material, and a fan operatively supported by said head and disposed radially below and adjacent to said cutter to aggressively output the reduced waste material from the rotor assembly of the waste processing machine.

* * * * *